United States Patent [19]

Brocklehurst

[11] Patent Number: 4,729,555

[45] Date of Patent: Mar. 8, 1988

[54] COMPACT HIGH SPEED STACKER

[75] Inventor: Charles E. Brocklehurst, Fountain Inn, S.C.

[73] Assignee: Sew Simple Systems, Inc., Fountain Inn, S.C.

[21] Appl. No.: 917,203

[22] Filed: Oct. 9, 1986

[51] Int. Cl.[4] ..... B65H 29/54

[52] U.S. Cl. ..... 271/175; 112/121.29; 271/176; 271/184; 271/199; 271/203; 271/85

[58] Field of Search ..... 271/175, 176, 184, 199, 271/203, 84, 85, 213; 112/121.29

[56] References Cited

U.S. PATENT DOCUMENTS

| | | | |
|---|---|---|---|
| 2,291,754 | 8/1942 | Piazze | 164/61 |
| 2,682,344 | 6/1954 | Preis et al. | 214/6 |
| 3,191,927 | 6/1965 | Hartbauer et al. | 271/57 |
| 3,264,917 | 8/1966 | Califano et al. | 83/94 |
| 3,537,702 | 11/1970 | Kosrow | 271/175 X |
| 3,780,682 | 12/1973 | Frost | 112/121.29 X |
| 3,796,171 | 3/1974 | Arbter | 112/121.15 |
| 3,880,059 | 4/1975 | Brockmuller | 93/93 |
| 4,399,991 | 8/1983 | Everall | 271/175 |
| 4,499,834 | 2/1985 | Ruetschle et al. | 112/2 |
| 4,595,133 | 6/1986 | Brocklehurst | 226/34 |

*Primary Examiner*—Richard A. Schacher
*Attorney, Agent, or Firm*—Thomas & Kennedy

[57] ABSTRACT

Sheet material 10 is advanced from a reel 11, cut by cutter 14 and then each segment is moved parallel to its cut edges through sewing machines 22, 23 so as to sew the hems of the work product. The finished product is advanced rapidly in its direction of movement to transfer roll 85, one end 18 of the work product is pulled over a conveyor while the trailing end is urged against the high speed transfer roll 85 which rapidly pulls the trailing portion 19 of the work product out of the way of the next oncoming work product and directs the trailing portion of the work product downwardly to the near side of the conveyor. Each bundle 28 of work products is advanced out of the way so as to make room for accumulating a subsequent bundle on the conveyor.

9 Claims, 4 Drawing Figures

COMPACT HIGH SPEED STACKER

BACKGROUND OF THE INVENTION

This invention relates generally to a stacker which functions to stack towels and other flat textile work products after the work products have been moved through a manufacturing process. More particularly, the invention relates to a compact high speed stacker used in connection with an end hemmer or similar apparatus which moves towels, sheets or other flat goods in closely spaced relationship through a sewing process, with the stacker functioning to rapidly move the work products out of the way of the next oncoming work product and to form a series of stacks of the work product.

In the production of towels, sheets and other flat textile work products, where the work products are formed by cutting them to length and then hemming the cut ends thereof, automated cutting and hemming equipment is utilized whereby the work products are cut to length and moved rapidly and in closely spaced relationship through hemming machines, etc. When each work product has been properly hemmed, it is desirable to move the completed work product out of the way of the next oncoming product and to neatly stack the finished work products.

One of the problems in stacking flat textile work products is rapid removal of the work product out of the way of an oncoming work product that is still being sewn or otherwise processed. If the completed work product is not quickly removed from the oncoming work product, it might be necessary to interrupt the manufacturing process.

Also, if the work products are of large size, the rapid removal of the work product from the process line is more difficult and usually requires larger, more expensive stacking equipment that occupies more space on the work floor of the mill. If the work products being processed vary in size, sometimes inadvertently, the stacker must have the capability of quickly removing the larger products as well as the smaller products.

For example, in a process in which toweling is cut to length and the cut ends are hemmed, if the cutter misses one of the cut cycles, a towel having twice the normal length might be processed through the hemmer. The stacker typically used at the delivery end of the hemmer would have to remove the extra long towel from the hemmer in the normal time between cycles of the hemmer and stacker in order to avoid interrupting the function of the hemmer.

Further, when the work product is being stacked, if the stacking function is performed too rapidly, the stacks or bundles of the work product that are formed by the stacking operation might be improperly formed, with wrinkles formed in the work products or with some of the work products being out of aligned position from the other products or misplaced from the stack or bundle.

When towels, sheets and other flat textile work products are being hemmed with the modern cutting and hemming equipment such as disclosed in U.S. Pat. No. 4,595,133, the hemming process is performed with high speed sewing machines so as to achieve a desirable high production rate, and it is even more critical that high speed, accurate stacking of the finished work product be performed without interruption of the high speed sewing system.

SUMMARY OF THE INVENTION

Briefly described, the present invention comprises a high speed compact stacker for use with, for example, an end hemmer for flat textile goods, such as towels or sheets, whereby the completed work product that is moving away from the end hemmer is moved at a more rapid rate away from the end hemmer so as to create additional space between the completed work product and the next oncoming work product, and then the completed work product is moved at a right angle through a compact stacker which pulls the leading edge of the work product across a surface conveyor and then rapidly pulls the trailing end of the work product toward but downwardly with respect to the surface conveyor, thus draping the work product across the surface conveyor. The rapid pulling of the trailing end of the work product is performed with a high speed transfer roll and a deflector which clamp against the work product, with the transfer roll rapidly pulling the work product out of the way of the next oncoming work product. The adjacent deflector accurately guides the fast moving trailing end portion of the work product to its proper location adjacent the surface conveyor. The velocity of the trailing portion of the work product is high enough so that work products having lengths up to four times the normal length can be handled by the stacker without interrupting the function of the hemmer.

After a predetermined number of cycles of operation have occurred so as to stack a predetermined number of the work products on the surface conveyor, the surface conveyor is advanced a short distance so as to present a new surface to the oncoming work products, to form a new stack of work products.

Thus, it is an object of this invention to provide a high speed compact stacker for a textile sewing operation which accurately and rapidly stacks the completed work products without inhibiting the operation of the textile sewing process.

Another object of this invention is to provide a high speed compact stacker which requires a minimum of floor space and which functions to rapidly remove the completed work products from the processing system and accurately stack the work products on a surface conveyor or the like for subsequent handling.

Another object of this invention is to provide an improved process for finishing and stacking flat textile work products, such as sheets or towels, which functions automatically and continuously to remove the completed work products from the processing line and which rapidly and accurately stacks the work products.

Other objects, features and advantages of this invention will become apparent upon reading the following specification, when taken in conjunction with the accompanying drawings.

DETAILED DESCRIPTION

Figure 1:
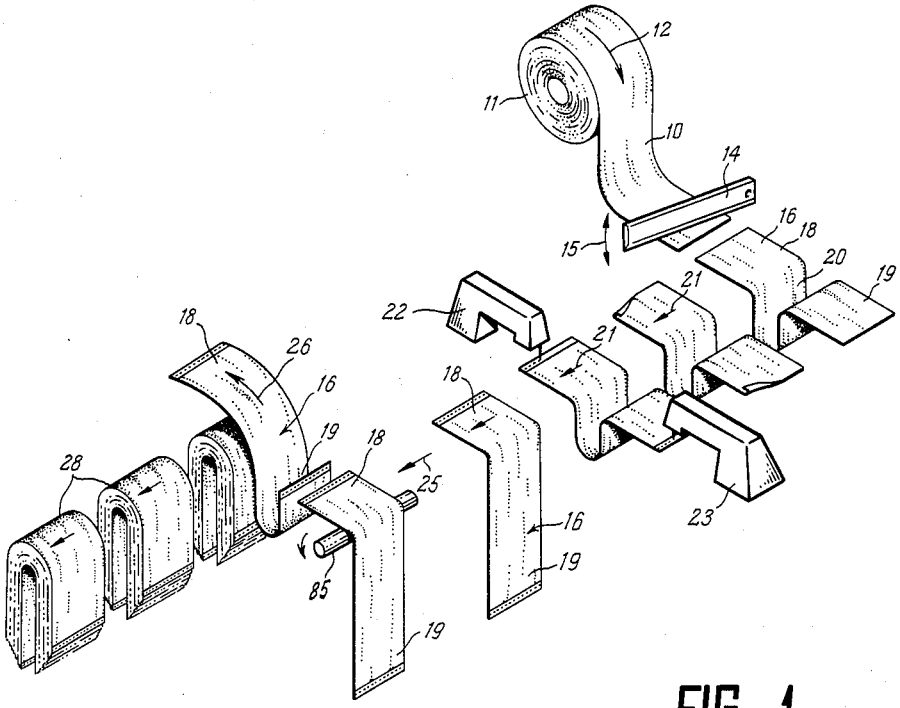
FIG. 1 is a schematic illustration of the end hemming process and stacking process by which work products are cut, the ends thereof hemmed, and then finally stacked in bundles.

Referring now in more detail to the drawings, in which like numerals indicate like parts throughout the several views, FIG. 1 shows a schematic illustration of how the continuous supply of toweling or other flat textile work product is cut to length, the ends thereof hemmed, and then the completed work product formed in stacks. The uncut supply of work product 10 is taken from a supply such as reel 11 and moved along its length as indicated by arrow 12 into a cutting station where a guillotine cutter 14 pivots as indicated by double headed arrow 15 so as to cut the material to length and form individual work products 16. The end portions 18 and 19 of each work product are supported on work tables, while the intermediate portion 20 is allowed to droop between the end portions.

After the work product 16 has been cut and is in the configuration described, the work product is then moved in a right angle direction extending across its length as indicated by arrow 21. As the work product moves in the direction indicated by arrows 21, its cut ends are folded over and sewn by sewing machines 22 and 23. The folding of the hems and sewing of the hems can be performed by prior art hemmers, such as those described in U.S. Pat. Nos. 3,772,948, 3,773,002, 3,906,878, 4,134,184 and 4,595,133.

After the work products have been hemmed by the end hemming apparatus, the end portion 19 of each work product is released, while the other end portion 18 is controlled by conveyor belts, and the work product is rapidly advanced in the same direction as indicated by direction arrow 25 until the end portion 18 of the work product extends over a transfer roll 85, whereupon the movement in the direction across the length of the work product is terminated and the end portion 18 of the work product is pulled in a direction indicated by arrow 26 along the length of the work product, and the other end portion 19 is pulled rapidly by the transfer roll 85 and deflected downwardly. This causes the work product to straddle a surface conveyor, and become draped in an inverted U-shaped configuration.

After a predetermined number of the work products 16 have been stacked in this manner in a bundle 28, the bundle 28 is advanced out of the way of the next oncoming completed work product. Thus, a series of bundles 28 of the work product is formed.

Figure 2:
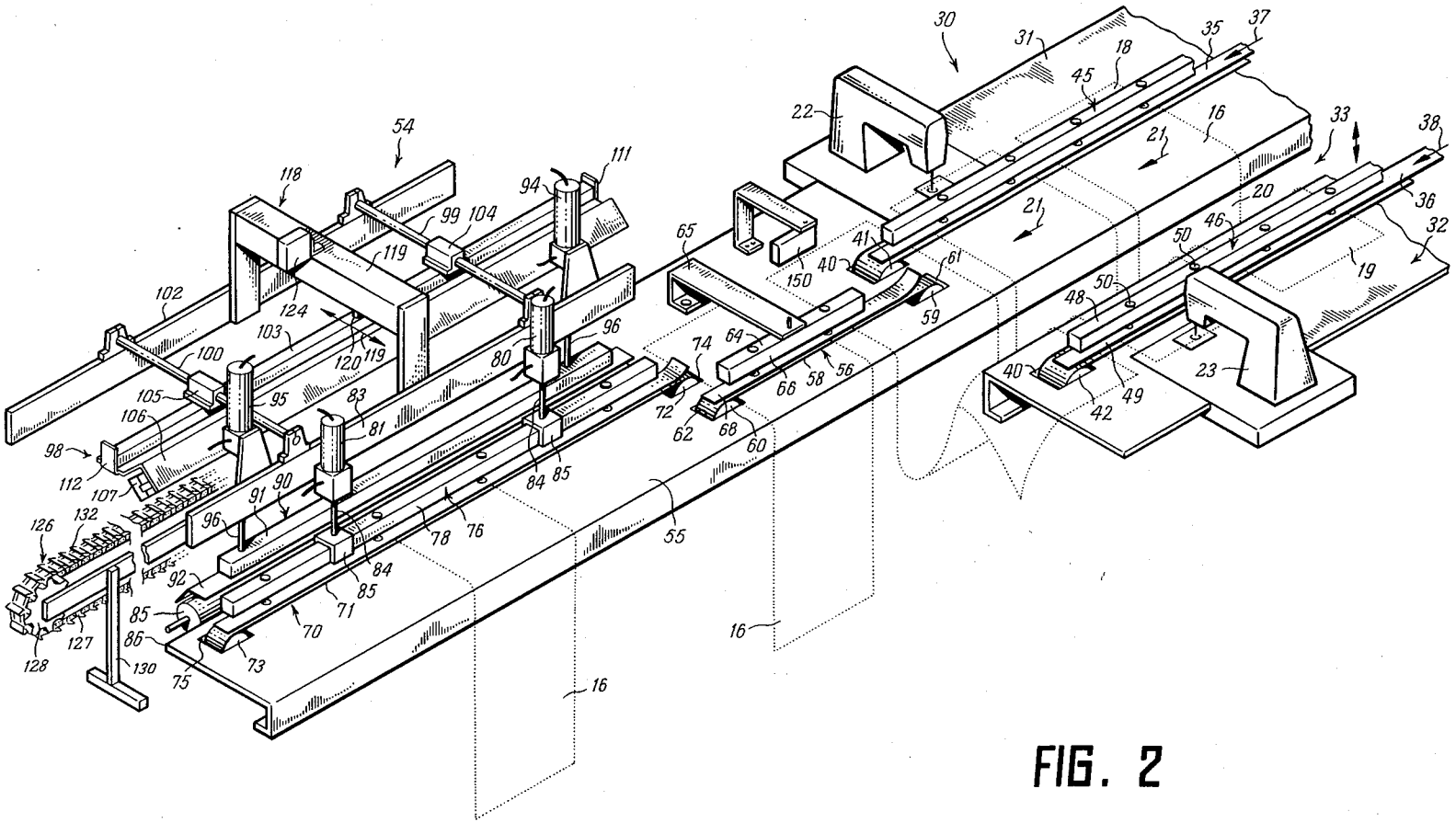
FIG. 2 is a perspective illustration of the end portion of the end hemmer and of the compact high speed stacker which is positioned adjacent the end hemmer.

As illustrated in FIG. 2, the delivery end portion of the end hemmer 30 includes work tables 31 and 32 separated by a gap 33. The work products 16 are indicated in dashed lines as having their end portions 18 and 19 supported on the work tables and their intermediate portions 20 hanging downwardly in the gap 33 between the work tables.

Surface belt conveyors 35 and 36 move in the directions indicated by direction arrows 37 and 38, with the work products lying on the upper exposed surfaces of the belt conveyors. The belt conveyors travel over the surface of the work tables 31 and 32 and move through openings 39 and 40 of the work table about guide rolls 41 and 42.

Belt clamp assemblies 45 and 46 are supported over surface belt conveyors 35 and 36, with each belt clamp assembly 45 including a rectilinear support frame 48, and a rectilinear skid 49 suspended beneath the support frame 48 by a series of connector pins 50. Coil compression springs 51 bias the skid downwardly from the support frame, and the skid is urged toward yieldable contact with its conveyor belt. Thus, when the work product 16 is moved to a position between the belt clamp assembly 45 or 46 and its surface belt conveyor 35 or 36, the force applied to the work product by the skid 49 urges the work product into frictional engagement with the surface belt conveyor, so that the surface belt conveyor moves the work product as indicated by the direction arrows 21. The framework that supports the belt clamp assemblies 45 and 46 has been omitted from the drawing for clarity. Likewise, the drive connection between the guide rolls 41 and 42 and the sewing machine motor have not been illustrated in detail, but it will be understood by those skilled in the art that the guide rolls 41 and 42 are driven in unison with their sewing machines 22 and 23 and rotate with a surface velocity that carries the surface belt conveyors 35 and 36 at a linear velocity which is compatible with the speed of operation of the sewing machines 22 and 23. Thus, sewing machines 22 and 23 tend to sew hems into the end portions 18 and 19 of the work products 16 as the work products are carried through the sewing machine by the surface belt conveyors 35 and 36. A high speed end hemmer suitable for use with the stacker is disclosed in more detail in U.S. Pat. No. 4,595,133.

The compact high speed stacker 54 is positioned at the delivery end of the end hemmer 30 and its work table 55 is a continuation of the work table 31 of the end hemmer. A narrow short surface belt conveyor 56 is similar to surface belt conveyors 35 and 36 and includes a conveyor belt 58 extending about conveyor belt drive rolls 59 and 60 which are positioned beneath the work table surface, with the conveyor belt 58 extending upwardly through the openings 61 and 62, with its upper flight moving over the surface of the work table and with the return flight extending beneath the table. The conveyor belt 58 is driven in the direction as indicated by arrows 21, with the conveyor belt drive roll 59 being driven on the same axle as conveyor belt drive roll 41 of the end hemmer 30. Thus, conveyor belt 58 is normally driven at the same linear velocity as the conveyor belt 35 as will be described in more detail later.

Belt clamp assembly 64 is permanently mounted over surface belt conveyor 56 by support bracket 65. Belt clamp assembly 64 is similar in construction to belt clamp assemblies 45 and 46, in that it includes the support frame 66 and the skid 68 which is suspended beneath the frame and spring biased in a downward direction toward engagement with the conveyor belt 58. The narrow short surface belt conveyor 56 is laterally offset from surface belt conveyor 35 toward the gap 33 between the work tables so that the work products 16 will be driven in the same direction and at the same velocity by the narrow short surface belt conveyor 56 as the work products move off the end of surface belt conveyor 35 and on into compact high speed stacker 54.

The longer and wider surface belt conveyor 70 is aligned with surface belt conveyor 35 of the end hemmer 30, and, like the previously described belt conveyors 35, 36 and 56, includes a continuous conveyor belt 71 extending about belt rolls 72 and 73, with the belt extending across the work table 55 and extending downwardly through openings 74 and 75 in the work table and about the rolls which are positioned beneath the work table. Belt clamp assembly 76 is positioned over and in alignment with surface belt conveyor 70, and like belt clamp assemblies 45, 46 and 64, the belt clamp assembly 76 includes a rectilinear support frame 78 and skid 79 suspended beneath the support frame and spring urged in a downward direction from the support frame toward engagement with conveyor belt 71. Conveyor roll 72 is driven in unison with conveyor roll 60, with the conveyor rolls being driven on a common shaft. Thus, when the work products 16 move beyond surface belt conveyor 56, the work products move on surface belt conveyor 70 of the stacker 54 at the same speed.

The support frame 78 of the belt clamp assembly 76 of surface belt conveyor 70 is movably supported by fluid actuated cylinders 80 and 81. The cylinders 80 and 81 are mounted to rigid frame member 82, and the cylinder rods 84 of each cylinder 80 are connected by means of a bracket 85 to the support frame 78. Thus, the cylinders 80 and 81 function to lift the belt clamp assembly 76 upwardly away from surface belt conveyor 70, or to move the belt clamp assembly 76 down toward engagement with the surface belt conveyor 70.

Transfer roll 85 is positioned adjacent the rear edge 86 of work table 55 and extends parallel to surface belt conveyor 70. The upper curved surface of transfer roll 85 is in approximately the same plane as the upper surface of work table 55, so that the end portions 18 of the work products 16 will move across the upper surface of the transfer roll 85 as they are carried by the surface belt conveyor 70.

Deflector assembly 90 is positioned above transfer roll 85 and includes an elongated rectilinear frame member 91 and elongated deflector plate 92 which is mounted to the lower surface of the frame member. A pair of fluid actuated cylinders 94 and 95 are each mounted to frame 82, and the downwardly projecting cylinder rods 96 of each cylinder 94 and 95 are connected to frame member 91, so as to lower and raise the deflector assembly toward and away from transfer roll 85. With this arrangement, when the end portions 18 of the work products 16 have been carried to a position where they rest on the transfer roll 85, the deflector assembly 90 can be lowered down into engagement with the work product, and the downward force applied by the deflector assembly 90 toward the transfer roll will cause the work products 16 to be frictionally engaged by the rotating surface of the transfer roll, whereupon the transfer roll will push the work product on into the stacker 54 at a velocity which corresponds to the surface velocity of the transfer roll.

Clamp assembly 98 is positioned behind transfer roll 95 and is mounted upon a pair of travel rods 99 and 100. Travel rods 99 and 100 are mounted upon frame members 82 and 102, with the travel rods being parallel to each other.

Clamp assembly 98 includes support bar 103 with slide blocks 104 and 105 rigidly mounted to the support bar, and with the openings of the slide blocks slidably mounted on the travel rods 99 and 100. Upper clamp plate 106 is rigidly suspended beneath support bar 103, and lower clamp plate 107 is pivotably mounted to upper clamp plate 106. Fluid actuated cylinders 108 (FIG. 4) are mounted to upper clamp plate 106, and the cylinder rods 109 are pivotably connected to lower clamp plate 107 by a link 110. End support plates 111 and 112 rigidly support upper clamp plate 106 to the support bar 103 and pivotably mount the lower clamp plate 107 in its position beneath the upper clamp plate 106 so that the lower edge 114 of the lower clamp plate 107 pivots toward and away from the lower edge 115 of upper clamp plate 106.

A drive assembly 118 is positioned above clamp assembly 98 and is arranged to move the clamp assembly 98 back and forth as indicated by double headed arrow 119, toward and away from transfer roll 85. Drive assembly 118 comprises a fluid operated cylinder (not shown) located within drive housing 119, with the cylinder rod connected to a connector link 120 which is rigidly connected to support bar 103 of the clamp assembly 98. Drive housing 119 is supported at its ends on frame elements 82 and 102. A position detector, such as a proximity switch or photocell 124 is mounted along the path of movement of the clamp assembly 98 so as to determine when the clamp assembly has moved a predetermined distance from transfer roll 85. The position detector controls the operation of the fluid actuated cylinder of drive assembly 118, so as to limit the movement of the clamp assembly 98 away from the transfer roll 85. The position detector 124 can be relocated along the length of the drive housing 119, if desired, in order to change the amplitude of movement of the clamp assembly 98.

Figure 4:
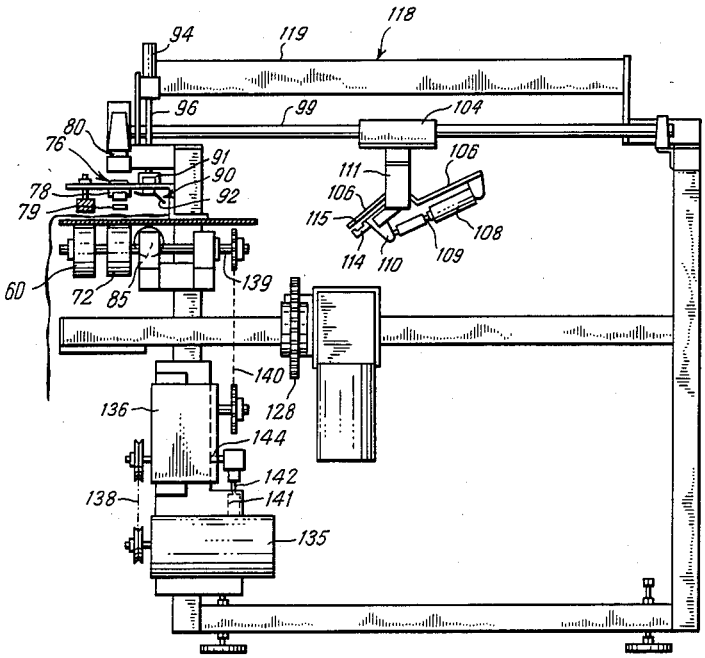
FIG. 4 is a side elevational view of the compact high speed stacker.

Surface conveyor 126 is positioned below the path of movement of clamp assembly 98, and includes a continuous roller chain 127 which extends around sprockets 128 and 129, with the sprockets being supported by a frame 130. Motor 131 drives sprocket 128 (FIG. 4). The upper flight 132 of the chain 127 is located at a distance below the path of travel of the clamp assembly 98 so that the clamp assembly can carry the end portions 18 of the work products 16 across the surface conveyor 126 and accumulate a bundle of work products 16 on the surface conveyor 126 when the surface conveyor is not in motion. After a predetermined number of cycles of the clamp assembly 98 has occurred, the surface conveyor 126 can be operated for a moment so as to move the accumulated bundle out of the way and a new bundle of the work products can be accumulated in an empty space on the surface conveyor (FIG. 1).

Although the surface conveyor 126 is described above, the stacker can use other types of receiving devices, including a belt conveyor (not shown).

Figure 3:
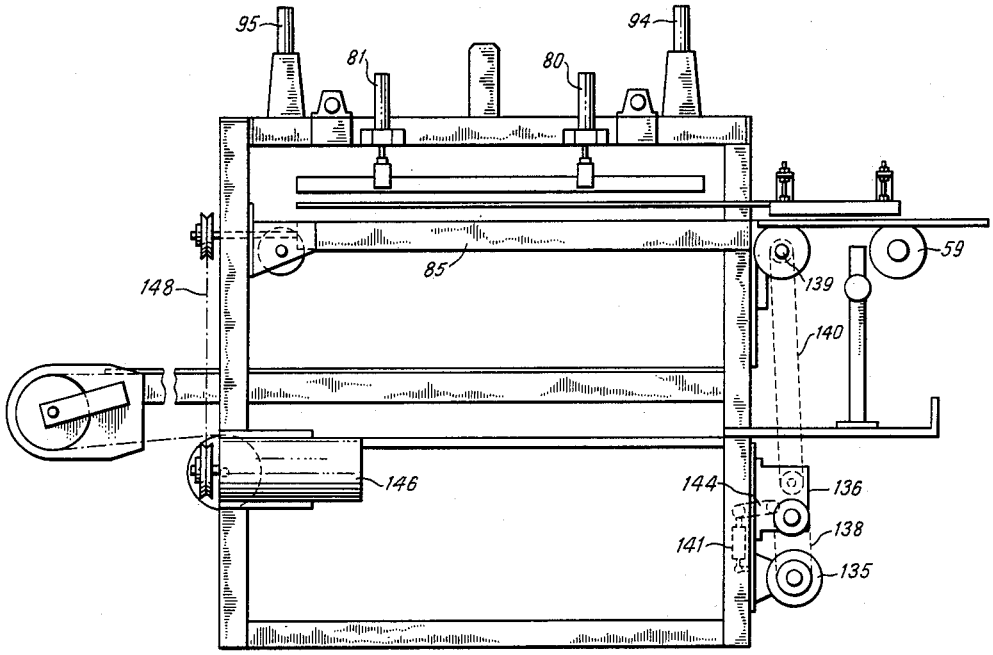
FIG. 3 is a front elevational view of the compact high speed stacker.

FIGS. 3 and 4 illustrate the drive system for the stacker 54 in more detail. Motor 135 drives the variable speed transmission 136 through sprockets and drive chain 138, and variable speed transmission 136 drives shaft 139 of conveyor belt drive rolls 60 and 72 by means of sprockets and drive chain 140. Fluid actuated cylinder 141 has its cylinder rod 142 connected to control lever 144 of variable speed transmission 136, so that the speed of operation of the drive chain and sprockets 140 which connect the variable speed transmission 136 to the drive shaft 139 can be controlled by air pressure.

As illustrated in FIG. 2, the narrow short surface belt conveyor 56 derives belt movement from the sewing machine motor of sewing machine 22, by the sewing machine motor operating drive roll 41, with the drive roll 41 being mounted on the same axle as drive roll 59 of the narrow short surface belt conveyor 56. Thus, the conveyor belt 58 not only drives its other drive roll 60, but drive roll 60 functions to drive the long wide surface belt conveyor 70 by means of a common drive shaft 139 (FIG. 4). Thus, the long wide surface belt conveyor 70 and the short narrow surface belt conveyor 56 both normally operate at a surface speed which is the same as the surface speed of belt conveyors 35 and 36. However, when variable speed transmission 136 is actuated by its air control cylinder 141, the drive linkage from motor 135 through the variable speed transmission 136 to the drive shaft 139 causes the drive shaft to rotate faster. This causes the narrow short surface belt conveyor 56 and the long wide surface belt conveyor 70 to move in a faster surface velocity than the surface velocity of the conveyors 35 and 36, so as to rapidly advance the work products 16 away from the end hemmer 30. Drive roll 59 includes a conventional one way override mechanism (not shown) so that the faster rotational velocity of the drive roller 59 does not effect the operational speed of surface conveyor 35 during the high speed operation of the surface belt conveyor 56.

As illustrated in FIG. 3, motor 146 is connected to transfer roll 85 by pulleys and V-belt 148. Motor 146 operates continuously to rotate transfer roll 85 at a surface velocity between approximately 10 and 13 feet per second.

OPERATION

As indicated in FIG. 2 by the dashed line representation of the work product 16, the work products are received in closely spaced series from the end hemmer 30 by the stacker 54 at a velocity of approximately 1 foot per second. The end portion 19 of each work product is allowed to run off the end hemmer and hang downwardly from the other end portion 18 of the work product as the work product is passed on from the end hemmer 30 to the stacker 54. In the meantime, the other end portion 18 of the work product leaves the surface belt conveyor 35 which is associated with sewing machine 22, with the work product entering the narrow short surface belt conveyor 56. The narrow short surface belt conveyor 56 and the wide long surface belt conveyor 70 of the stacker 54 are in their "idling" mode, so that they are driven by the sewing machine motor that drives sewing machine 22, and they operate at the same surface speed as the sewing machine 22.

Photoelectric cell 150 is located at the end of surface belt conveyor 35 and is programmed to detect the movement of the trailing edge of the work product 16 as the work product makes the transition from surface belt conveyor 35 to the narrow short surface belt conveyor 56. Upon making this detection, the cycle of operation of the stacker is initiated.

In response to the detection of the trailing portion of the work product by photoelectric cell 150, the narrow short and wide long surface belt conveyors 56 and 70 begin their high speed mode of operation, by actuation of the variable speed transmission 136. This is accomplished by the control system (not shown) shifting the operator lever 144 of the variable speed transmission, so that the variable speed transmission transmits rotary motion from motor 135 to the drive shaft 139 of both belt rollers 60 and 72 of the surface belt conveyors 56 an 70. Thus, these surface belt conveyors will move at a faster surface velocity of about three feet per second to rapidly move the work product 16 away from the end hemmer 30 and on further into the stacker 54. In the meantime, the belt clamp assembly 64 of the narrow short surface belt conveyor 56 urges the work product into contact with the moving belt 58, and the belt clamp assembly 76 of the long wide surface belt conveyor 70 moves downwardly to bias the oncoming work product into engagement with the moving conveyor belt 71. This causes the work product to remain in positive control as the work product moves further in the system, and the end portion 18 of the work product is moved over the upper surface of the transfer roll 85 and into the open jaw of the clamp assembly 98.

After the predetermine time lapse from the instant when the photocell detects the movement of the trailing portion of the work product, the variable speed transmission 136 is shifted back to its non-driving mode so that surface belt conveyors 56 and 70 will move at the slower velocity as driven by the sewing machine motor, the belt clamp assembly 76 moves away from the conveyor belt 71 and the clamp assembly 98 closes onto the edge portion 18 of the work product 16. Further, the clamp assembly 98 is moved as indicated by arrow 119 away from the surface belt conveyor 70 toward the back of the stacker at a velocity of approximately four feet per second.

After a short time delay to permit the clamp assembly 98 to pass beneath deflector assembly 90 and over the conveyor 126, the cylinders 94 and 95 of the deflector assembly move the deflector plate 92 downwardly toward transfer roll 85. This causes the work product 16 to be urged into engagement with the constantly moving upper surface of the transfer roll which moves with a surface velocity of between approximately ten and thirteen feet per second, and the transfer roll urges the other end portion 19 of the work product on into the stacker, while the deflector plate 92 deflects the work product downwardly toward the near side of the stacker. This downward deflection causes the trailing end portion of the work product to move to the near side of the surface conveyor 126, and avoids the rapid movement of the work product from slinging the work product completely over and beyond the surface conveyor. Thus, the movement of the work product into the stacker is done very rapidly yet the direction of movement and placement of the work product into the bundle accumulated on the surface conveyor is accurately controlled.

When the clamp assembly 98 has moved to a position which can be detected by the position detector 124 (FIG. 2), detection by the position detector reverses the movement of the clamp assembly and the clamp assembly is opened, thereby dropping the leading end portion 18 of the work product 16, and returning the clamp assembly to its ready position adjacent transfer roller 85. Further, the detection of the clamp assembly lifts the deflector assembly 90 by actuating its fluid cylinders 94 and 95 so that the clamp assembly 98 can return to the transfer roller 85. When in this condition the stacker is ready for another cycle of operation.

It will be understood that the foregoing relates only to a preferred embodiment of the present invention, and that numerous changes and modifications may be made therein without departing from the spirit and scope of the invention as set forth in the following claims.

I claim:

1. A method of progressively stacking elongated sheets of textile material and the like which are received in spaced series moving at a substantially constant velocity in a direction extending across their lengths from a sheet treating operation or the like, comprising the steps of:

continuing the movement of each sheet in a direction extending across its length at a speed substantially the same as the speed of the sheets moving through the sheet treating operation until the sheet has cleared the sheet treating operation;

after each sheet has cleared the sheet treating operating advancing each sheet further away from the sheet treating operation in a direction extending across the length of the sheet at a greater speed so as to increase the space between the sheet and the next oncoming sheet until the sheet reaches a stacker in-feed position;

after each sheet has reached the stacker in-feed position grasping one end portion of each sheet and pulling the one end portion of the sheet at a first speed along the length of the sheet in a lateral direction over a surface conveyor, urging the trailing portion of the sheet toward the surface conveyor at a greater speed than said first speed while deflecting the trailing portion of the sheet downwardly until the sheet material clears the stacker in-feed position, and releasing the one end portion of the sheet to allow the sheet to fall onto the conveyor.

2. The method of claim 1 and wherein the steps of grasping one end portion of the sheet and pulling the sheet comprises engaging the end portion of the sheet with a clamp at the stacker in-feed position and moving the clamp with the sheet engaged by the clamp over the surface conveyor.

3. The method of claim 1 and wherein the step of urging the trailing portion of the sheet toward the surface conveyor at a greater speed comprises engaging the intermediate portion of the sheet with a feed roll and rotating the feed roll so as to progressively move the intermediate and then the trailing portions of the sheet with the feed roll toward the surface conveyor.

4. The method of claim 1 and wherein the step of continuing the movement of each sheet in a direction extending across the length of the sheet comprises urging an end portion of the sheet into engagement with a surface conveyor belt means and moving the surface conveyor belt at a speed substantially the same as the speed of the sheets moving through the sheet treating operation, and wherein the step of advancing the sheet further away from the sheet treating operation at a greater speed comprises moving the surface conveyor belt means at a greater speed.

5. The method of claim 1 and wherein the step of advancing each sheet further away from the sheet treating operation comprises advancing the one end portion of the sheet to a position extending over a transfer roll at the stacker in-feed position, and wherein the steps of urging the trailing portion of the sheet toward the surface conveyor while deflecting the trailing portion downwardly comprises moving a deflector plate toward the sheet and the transfer roll to urge the sheet into engagement with the transfer roll and rotating the transfer roll so as to move the intermediate and then the trailing portions of the sheet with the transfer roll and deflector plate in a downward direction toward the surface conveyor.

6. A method of stacking elongated flat textile work products as the work products are received in approximately equally spaced series from a prior work station in which the work products are advanced with one edge portion of each work product extending parallel to its direction of movement, comprising the steps of:

continuing to advance each work product in series along a path away from the prior work station with said one edge portion of the work product extending parallel to the direction of movement until said work product extends across the surface of a transfer roll, pulling the one edge portion of the work product in a direction extending at a right angle to said one edge portion laterally until the work product is over a stacking position, as the work product is being pulled toward the stacking position, moving a deflection plate toward the work product and the transfer roll to urge the work product into engagement with the transfer roll and rotating the transfer roll so as to urge the trailing portion of the work product along the length of the work product and simultaneously direct the trailing portion of the work product downwardly to the stacking position, releasing said one edge portion of the work product and allowing the work product to drop to the stacking position.

7. The method of claim 6 and wherein the steps of moving a deflection plate toward the work product and transfer roll and rotating the transfer roll comprise:

rotating the transfer roll at a surface velocity greater than the velocity at which said one end portion is being pulled so as to direct said trailing portion of the work product downwardly to the stacking position at a faster rate than said one end portion is pulled.

8. The method of claim 6 and wherein the step of continuing to advance each work product in series along a path away from the prior work station comprises advancing the work product at a faster rate than the rate of advancement of the next oncoming work product through the prior work station to increase the space between the work product and the next oncoming work product.

9. Apparatus for stacking sheets of flexible textile material or the like received from a sheet treating apparatus in which elongated sheets are moved in spaced series in a direction extending across the lengths of the sheets, said apparatus comprising a surface conveyor belt system including a conveyor belt aligned with one end portion of the sheets as the sheets move from the sheet treating apparatus for continuing the movement of the sheets away from the sheet treating apparatus, detector means for detecting the movement of the trailing portions of the sheets away from the sheet treating apparatus, a transfer roll having its axis of rotation oriented approximately parallel to said conveyor belt, clamp means movable in lateral directions toward and away from said transfer roll for grasping and pulling one end portion of the sheet away from said transfer roll and over a surface conveyor or the like, motor means for rotating said transfer roll as said sheet is being moved by said clamp means at a surface speed greater than the speed at which said clamp means moves away from said transfer roll, deflector means movable toward and away from said transfer roll for urging the sheet into frictional contact with said transfer roll and to guide the sheet downwardly away from said transfer roll, whereby the transfer roll urges the other end of the sheet away from the transfer roll while the deflector means deflects the other end of the sheet downwardly toward the surface conveyor or the like as said one end portion is pulled by said clamp means, said clamp means being adapted to release the one end portion after the deflection of the other end.

* * * * *